US010426269B1

(12) United States Patent
O'Hara

(10) Patent No.: US 10,426,269 B1
(45) Date of Patent: Oct. 1, 2019

(54) CHAIR WITH APPENDAGE ACCOMMODATIONS

(71) Applicant: Buzz Seating, Inc., Cincinnati, OH (US)

(72) Inventor: Daniel O'Hara, Cincinnati, OH (US)

(73) Assignee: Buzz Seating, Inc., Cincinnati, OH (US)

( * ) Notice: Subject to any disclaimer, the term of this patent is extended or adjusted under 35 U.S.C. 154(b) by 0 days.

(21) Appl. No.: 15/966,836

(22) Filed: Apr. 30, 2018

(51) Int. Cl.
*A47C 1/024* (2006.01)
*A47C 3/026* (2006.01)
*A47C 7/54* (2006.01)

(52) U.S. Cl.
CPC ..... *A47C 7/543* (2013.01)

(58) Field of Classification Search
CPC ..... A47C 7/543
USPC ..... 297/285, 296, 297, 411.32, 411.35, 297/411.36, 411.38, 452.14, 452.15; D6/366, 716.4
See application file for complete search history.

(56) References Cited

U.S. PATENT DOCUMENTS

D288,747 S * 3/1987 Schultz ..... D6/366
D327,988 S * 7/1992 Citterio ..... D6/366
D328,199 S * 7/1992 Citterio ..... D6/366
D330,809 S * 11/1992 Citterio ..... D6/366
D332,011 S * 12/1992 Fahnstrom ..... D6/366 X
D332,182 S * 1/1993 Citterio ..... D6/366 X
D339,927 S * 10/1993 Fahnstrom ..... D6/366
D363,401 S * 10/1995 Wingerter ..... D6/716.4
D380,110 S * 6/1997 Tortel ..... D6/366
D394,961 S * 6/1998 Fancelli ..... D6/366
D401,771 S * 12/1998 Goodworth ..... D6/366
6,257,668 B1 * 7/2001 Chou ..... A47C 1/03 297/411.32
D451,293 S * 12/2001 Su ..... D6/366
D451,313 S * 12/2001 Tseng ..... D6/366
D451,692 S * 12/2001 Hasenbein ..... D6/366 X
D456,626 S * 5/2002 Su ..... D6/366
D461,323 S * 8/2002 Su ..... D6/366
D467,748 S * 12/2002 Lepper ..... D6/366
D467,749 S * 12/2002 Lepper ..... D6/366
D470,668 S * 2/2003 Mizell ..... D6/366 X
6,523,895 B1 * 2/2003 Vogtherr ..... A47C 1/024 297/291
D479,416 S * 9/2003 Raftery ..... D6/366
6,626,497 B2 * 9/2003 Nagamitsu ..... A47C 7/40 297/452.15
D484,710 S * 1/2004 Getzel ..... D6/366
D486,657 S * 2/2004 Su ..... D6/366
D490,621 S * 6/2004 Newhouse ..... D6/366
D494,768 S * 8/2004 Su ..... D6/366
D495,509 S * 9/2004 Breen ..... D6/366
6,837,545 B1 * 1/2005 Ho ..... A47C 1/03 297/411.36
D507,437 S * 7/2005 Klaasen ..... D6/366
(Continued)

*Primary Examiner* — Rodney B White
(74) *Attorney, Agent, or Firm* — Schwegman Lundberg & Woessner, P.A.

(57) ABSTRACT

A chair includes a back member and arm brackets. The back member is tapered toward an end that is adjacent to a seat. The arm brackets are attached under a bottom portion of the seat. Each arm bracket is adjustable to provide a seat clearance area for the seat when one or more of the arm brackets are adjusted up to approximately 90 degrees from an original upright position.

10 Claims, 13 Drawing Sheets

(56) References Cited

U.S. PATENT DOCUMENTS

D510,488 S * 10/2005 Su ..... D6/366
D566,410 S * 4/2008 Neil ..... D6/366
D570,625 S * 6/2008 Schweikarth ..... D6/366
D579,682 S * 11/2008 Neil ..... D6/366
D583,580 S * 12/2008 Hara ..... D6/366
7,618,090 B2 * 11/2009 Grenon ..... A47C 3/18 297/195.11 X
7,669,935 B2 * 3/2010 Crossley ..... A47C 3/12 297/452.36 X
D618,927 S * 7/2010 Zhang ..... D6/366
7,832,805 B1 * 11/2010 Lai ..... A47C 1/03 297/411.32 X
D639,576 S * 6/2011 Breen ..... D6/366
D640,477 S * 6/2011 Neil ..... D6/366
D640,478 S * 6/2011 Neil ..... D6/366
D646,093 S * 10/2011 Collinson ..... D6/716.4
D704,945 S * 5/2014 Massaud ..... D6/366
D714,563 S * 10/2014 Amdal ..... D6/366
8,876,209 B2 * 11/2014 Peterson ..... A47C 3/12 297/452.15 X
8,973,990 B2 * 3/2015 Krupiczewicz ..... A47C 31/02 297/452.14 X
8,998,339 B2 * 4/2015 Peterson ..... A47C 1/024 297/452.14 X
D736,006 S * 8/2015 Wold ..... D6/366
9,326,607 B2 * 5/2016 Tsai ..... A47C 7/543
D792,120 S * 7/2017 Webb ..... D6/366
D792,717 S * 7/2017 Webb ..... D6/366
D793,112 S * 8/2017 Webb ..... D6/366
D800,469 S * 10/2017 Barber ..... D6/366
D800,470 S * 10/2017 Barber ..... D6/366
D800,471 S * 10/2017 Barber ..... D6/366
D800,472 S * 10/2017 Meda ..... D6/366
D801,066 S * 10/2017 Barber ..... D6/366
D801,067 S * 10/2017 Barber ..... D6/366
D801,717 S * 11/2017 Barber ..... D6/366
D801,718 S * 11/2017 Barber ..... D6/366
D802,314 S * 11/2017 Barber ..... D6/366
2007/0052275 A1 * 3/2007 Ghilzai ..... A47C 1/06 297/423.12
2007/0164594 A1 * 7/2007 Yang ..... A47C 1/03 297/411.32
2008/0054700 A1 * 3/2008 Meidan ..... A47C 1/03238 297/361.1
2015/0265058 A1 * 9/2015 Igarashi ..... A47C 7/445 297/285
2016/0135603 A1 * 5/2016 Chan ..... A47C 7/36 297/285 X

* cited by examiner

CHAIR WITH APPENDAGE ACCOMMODATIONS

BACKGROUND

Chairs come in all shapes, sizes, and functional abilities in the industry. For example, chairs are available for general office use: including basic or advanced ergonomic features; applications such as health care, commercial, or special needs applications; and accommodation of different physiques and statures. Buzz Seating conceived and designed the Shield Chair to accommodate maintenance, utility, security, law enforcement or anyone wearing a utility or duty belt that can obstruct the ability to get in or out of a restrictive chair, resulting in damage to the chair and/or the belt contents, or possible injury to the individual.

However, existing chairs fail to adequately accommodate individuals who wear tools or weaponry. Individuals can become encumbered or entangled, restricting motion and access, because of duty belts and associated tools or equipment, such as flashlights, communication devices, manual tools, weaponry and utilitarian accessories. As a result, an individual is forced to remove the contents of the belt or the belt itself before sitting in existing chairs. In some cases, this may even cause a security risk because weaponry has to be removed from a law enforcement officer, military member, or security staff before the user is able to sit in an existing chair. For instance, depending on the circumstances, an officer attempting to sit in an existing chair with attached weaponry could cause an accidental discharge of a weapon or inadvertently cause a safety mechanism to be turned off should the officer forcibly attempt to sit in the chair.

In the case of tools, the tools can be misplaced, lost, or stolen when removed from the individual.

Additionally, when an individual attempts to sit in existing chairs with attached weaponry or tools, the chair can be severely damaged (ripped) or broken. Weaponry and tools tend to be very heavy with sharp/jagged edges, such that functional mechanisms of the chair can break and comfort mechanism of the chair (e.g., upholstery, etc.) can rip or tear. A sturdy chair could also cause the weaponry or tools to be damaged when the individual forcibly attempts to sit in that chair.

Still further and with existing chairs, individuals attempting to sit with attached tool or duty belt may get stuck in the chair when trying to stand up from the chair if they were actually successful in sitting in the chair in the first place.

Thus, there is a need for an approved chair that provides adequate support for individuals wearing attached weaponry and/or tools, promoting safety through ease of movement while allowing access to the duty belt, easing restrictions due to hardware.

SUMMARY

Various embodiments of the invention provide a chair with user appendage accommodations.

Specifically, and in one embodiment, a chair is provided. The chair includes a back member and arm brackets. The back member is tapered toward an end that is adjacent to a seat. The arm brackets are attached under a bottom portion of the seat. Each arm bracket is adjustable 90 degrees to provide a seat clearance area for the seat when one or more of the arm brackets are adjusted 90 degrees from an original upright position.

DETAILED DESCRIPTION

As will be demonstrated herein and below, a chair is provided that provides substantial clearance on the sides and at the back of the seat for an individual to comfortably sit in the chair with attached weaponry or tools.

The following diagrams are presented for illustration and it is to be noted that any dimensions and measurements illustrated represent embodiments of the chair and as such other embodiments may alter those dimensions and measurements without departing from the beneficial teachings presented herein and below.

Figure 1:
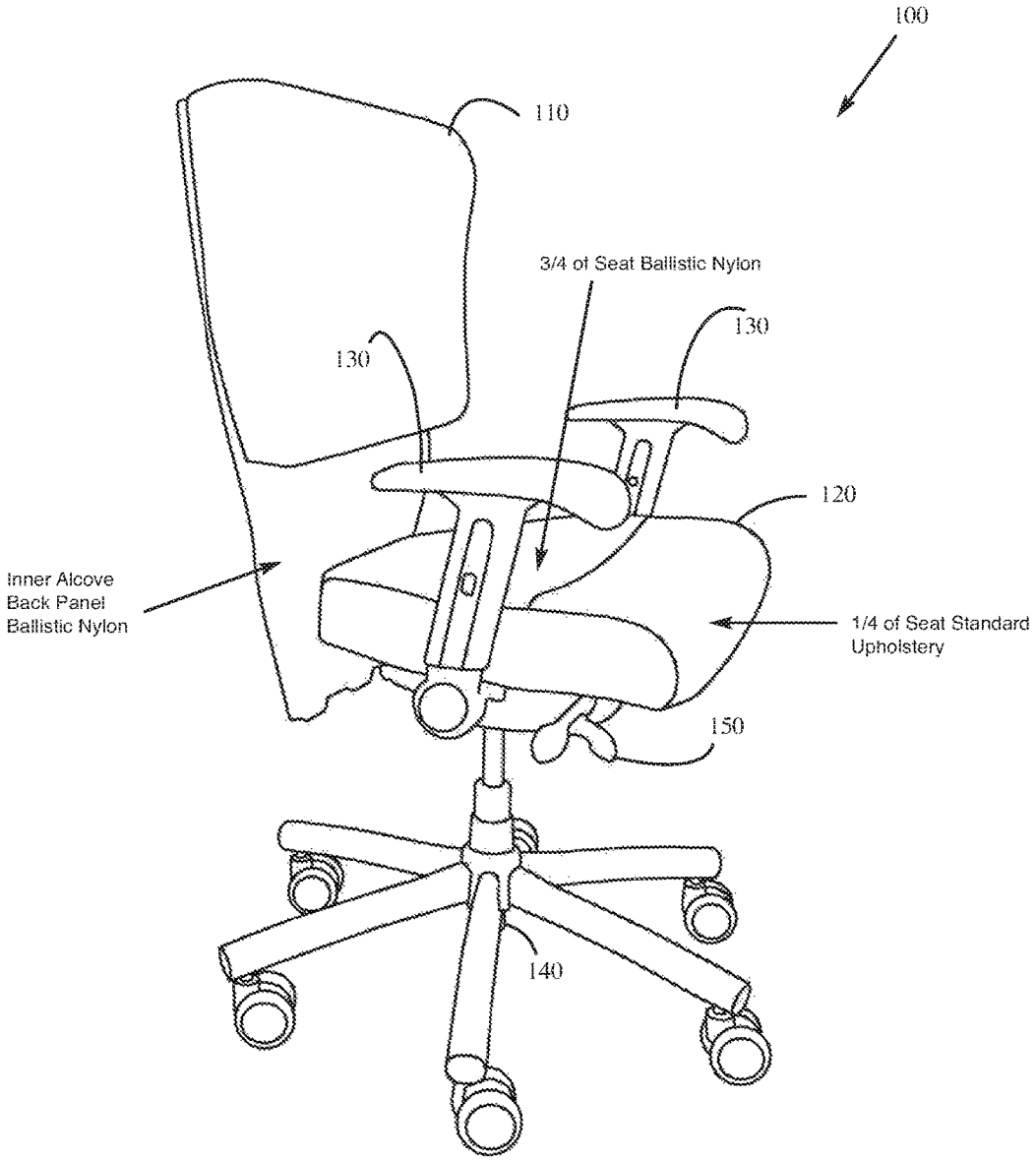
FIG. 1 is a diagram of a chair, according to an example embodiment presented herein.

FIG. 1 is a diagram of a chair 100, according to an example embodiment presented herein.

The chair 100 includes a back (or back member) 110, a seat 120, two retractable arm brackets 130, a base 140, and seat height and seat tilt adjustment levers 150 (just one lever illustrated in the side view of FIG. 1, both levers 150 are fully illustrated in FIG. 14 (discussed below)).

In an embodiment, the back 110 is constructed of multiple materials, with the tapered end that is adjacent to the back of the seat 120 being constructed as an inner alcove back panel upholstered with ballistic nylon material.

In an embodiment, three-quarters of the seat 120 is upholstered in ballistic nylon from the rear and forward. The top surface of the seat is upholstered in ballistic nylon material. The front surface of the (representing ¼ of the overall seat surface area) is upholstered with standard upholstery material.

Figure 2:
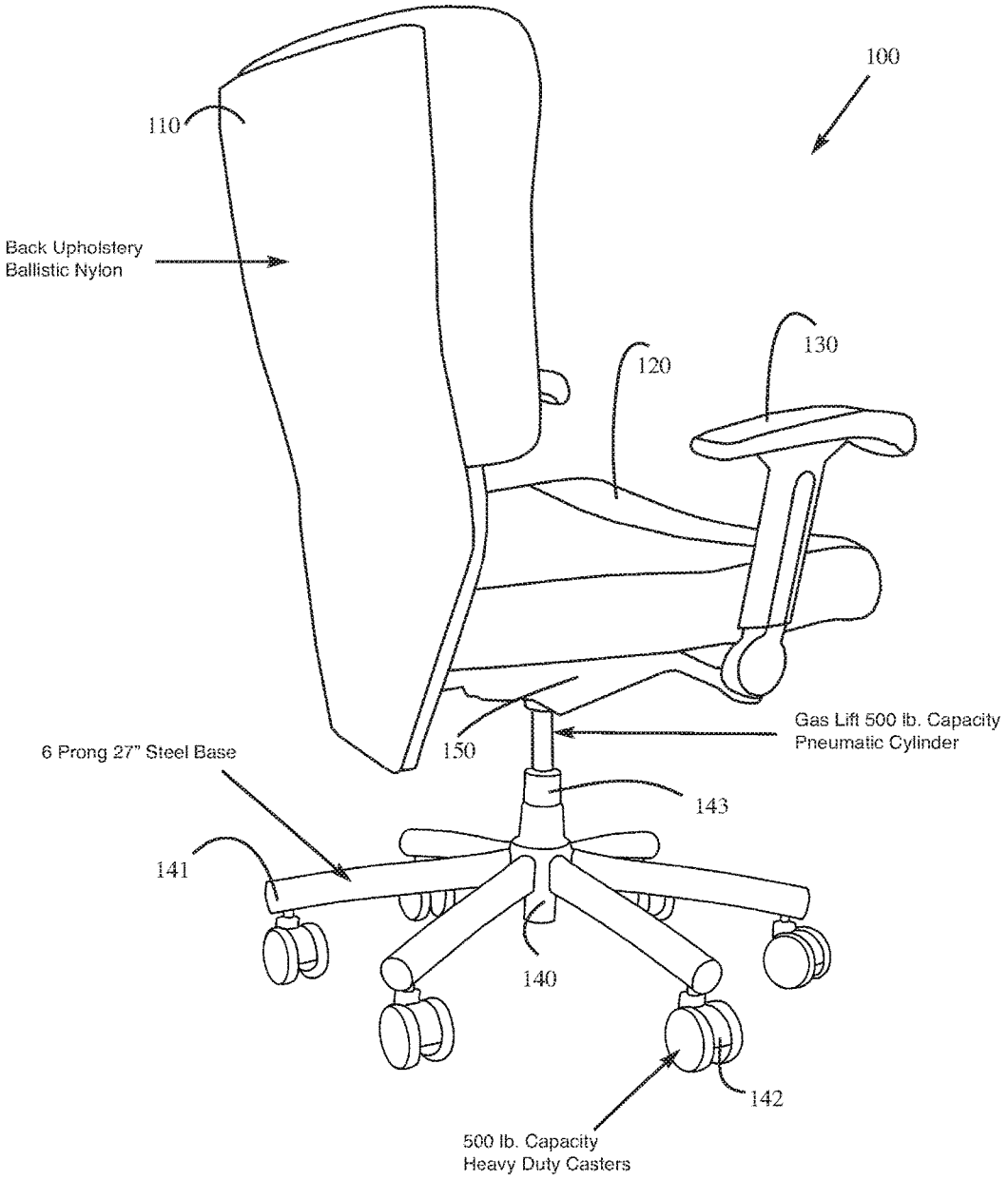
FIG. 2 is a diagram of a side view of the chair, according to an example embodiment.

FIG. 2 is a diagram of a side view and back of the chair 100, according to an example embodiment.

In an embodiment, a back surface of the back 110 is upholstered with ballistic nylon material.

The base 140 includes 6 legs 141, each leg 141 having a caster 142. The base also includes a cylinder 143.

In an embodiment, each wheel 142 is a heavy duty caster.

In an embodiment, the cylinder 143 is a gas lift 500 pound capacity pneumatic cylinder.

Figure 3:
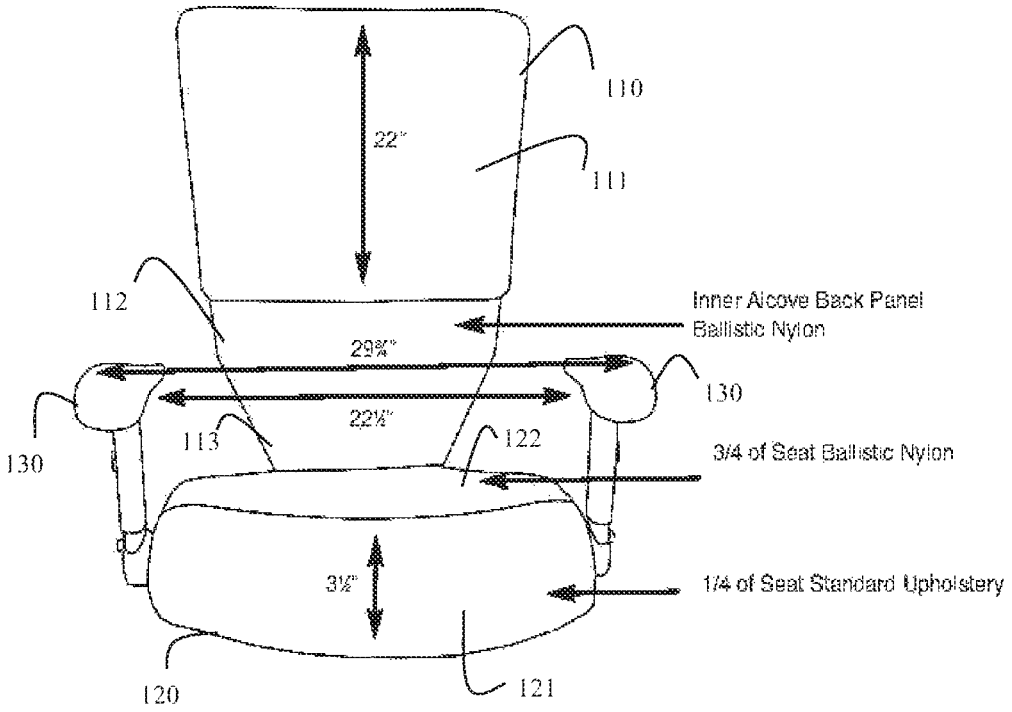
FIG. 3 is a diagram of a front view of the chair's back, seat, and arm brackets, according to an example embodiment.

FIG. 3 is a diagram of a front view of the chair's back 110, seat 120, and arm brackets 130, according to an example embodiment.

The back 110 includes three sections. The first section 111 extends from the top towards the seat 120 for approximately 22 inches. The second section 112 comes down 3.5 inches and then tapers from an end of the first section 111 at an angle of approximately 22 degrees and extends through the third section 113.

In an embodiment, a largest width of the seat 120 is approximately 22.5 inches.

In an embodiment, the distance between the arm brackets 130 is approximately 29.75 inches.

In an embodiment, a height of the front surface 121 of the seat 120 is approximately 3.5 inches thick.

Figure 4:
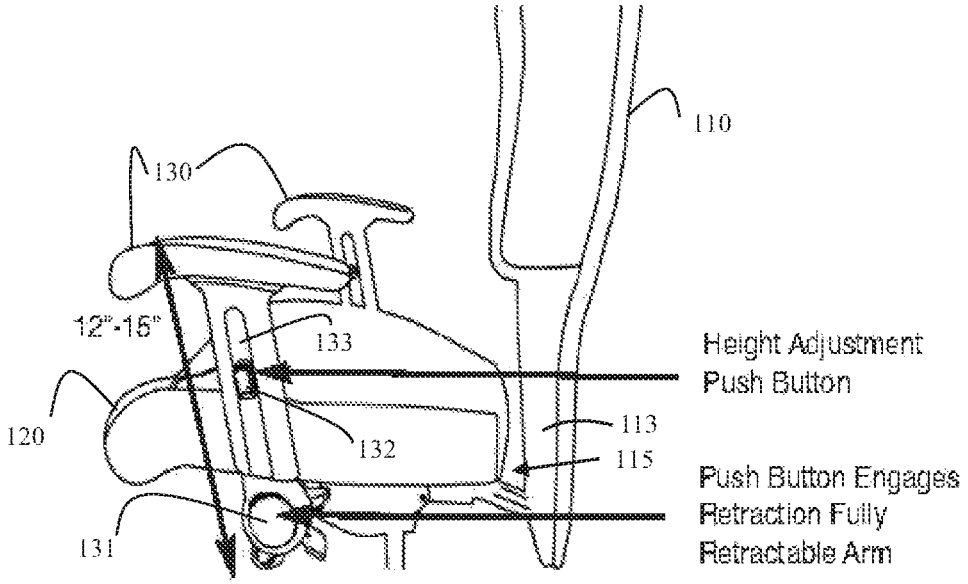
FIG. 4 is a diagram of a side view of arm brackets of the chair, according to an example embodiment.

FIG. 4 is a diagram of a side view of arm brackets 130 of the chair, according to an example embodiment.

The back 110 is attached to the seat 120 under the seat 120 and at the back of the seat 120. There is a gap 115 that exists between a back surface of the seat 120 and a front surface of the third portion 113 of the back 110.

Each arm bracket 130 is adjustable up and down and side to side. A height adjustment mechanism 132 when activated allows the arm brackets 130 is adjust up and down through slot 133.

In an embodiment, the height adjustment mechanism 132 is a button that, when depressed, allows the arm bracket 130 to slide up and down to adjust its height through the slot 133; when the button is released it locks into the slot 133 fixing the height of the arm bracket 130 at a user-adjusted position.

In an embodiment, the height adjustment from a base of the slot 133 ranges between approximately 12 to 15 inches.

The height adjustment mechanism 132 allows the brackets 130 to adjust while in a perpendicular position to the top surface of the seat 120.

Each arm bracket 130 also includes a retractable adjustment mechanism 131 that permits the arm bracket 130 to move forward and rearward relative to a side surface of the seat 120. The range of motion is approximately 90 degrees to the rearward position from its original upright position (shown in the FIG. 4) to each side (towards the front of the seat along the side and towards the back of the seat along the side).

Figure 5:
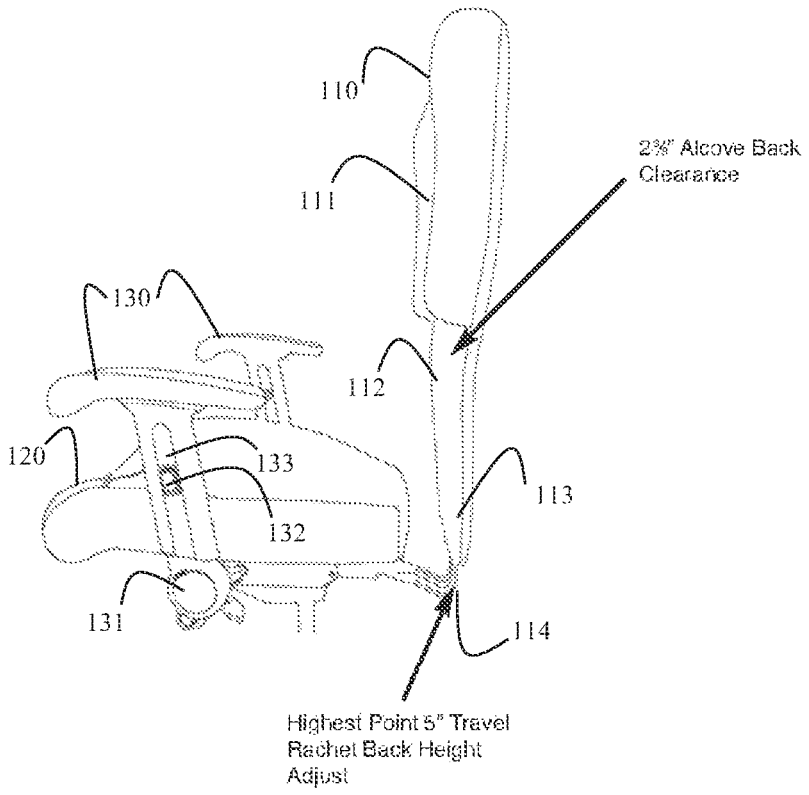
FIG. 5 is a diagram of a side view of the arm brackets and back of the chair, according to an example embodiment.

FIG. 5 is a diagram of a side view of the arm brackets 130 and back of the chair 110, according to an example embodiment.

In an embodiment, the back 110 is attached under the seat 120 at the back of the seat through a ratchet mechanism 114. The mechanism 114 allows the height of the back 110 to be adjusted up or down within a range of approximately 5 inches. The FIG. 5 illustrates the highest point of adjustment for the mechanism 114.

Figure 6:
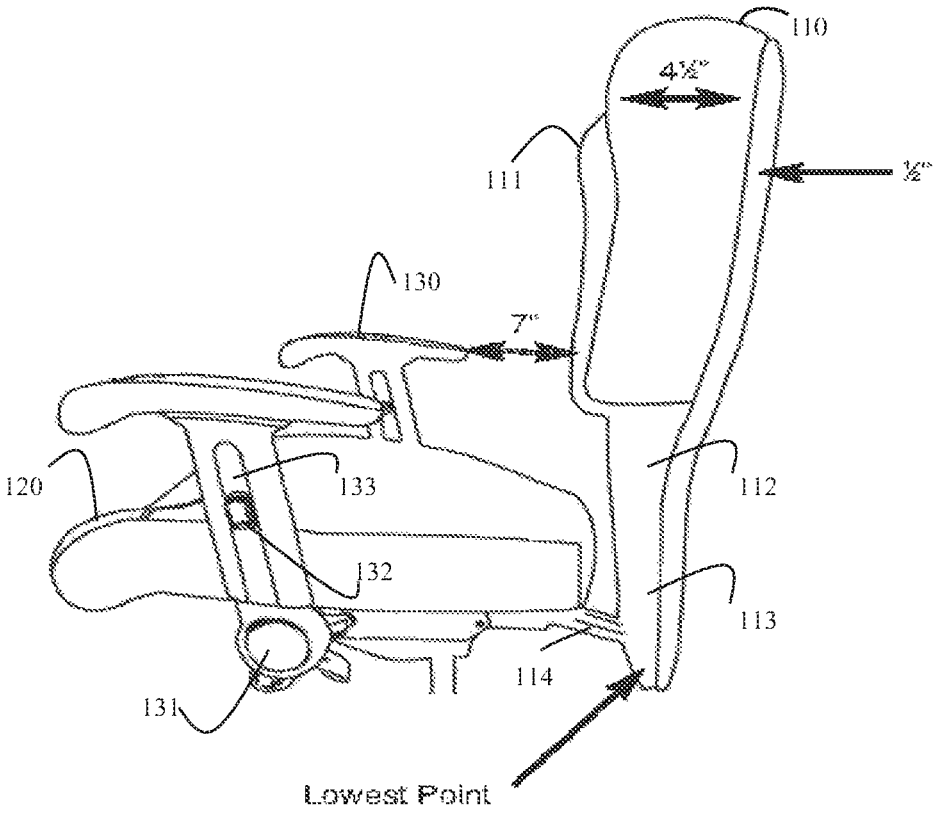
FIG. 6 is a diagram of another side view of the arm brackets and back of the chair, according to an example embodiment.

FIG. 6 is a diagram of another side view of the arm brackets 130 and back 110 of the chair, according to an example embodiment.

In an embodiment, the first portion 111 of the back 110 is approximately 4.5 inches thick with an additional 0.5 inch in thickness along the back of the back 110.

In an embodiment, a distance between back edges of the brackets 130 to a front surface of the first portion 111 of the back 110 is approximately 7 inches.

The FIG. 6 also illustrates the back 110 at its lowest height adjustment point made through the mechanism 114.

Figure 7:
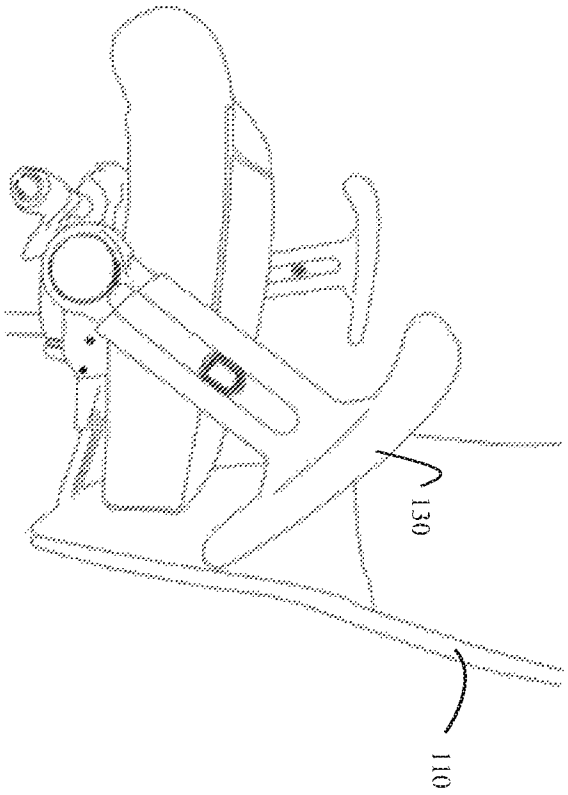
FIG. 7 is a diagram of one arm bracket being adjustably moved to a first position, according to an example embodiment.

FIG. 7 is a diagram of one arm bracket 130 being adjustably moved to a first position, according to an example embodiment.

FIG. 7 illustrates adjustable movement of the arm bracket 130 from an original upright position (illustrated in the FIG. 6) towards the back 110.

Figure 8:
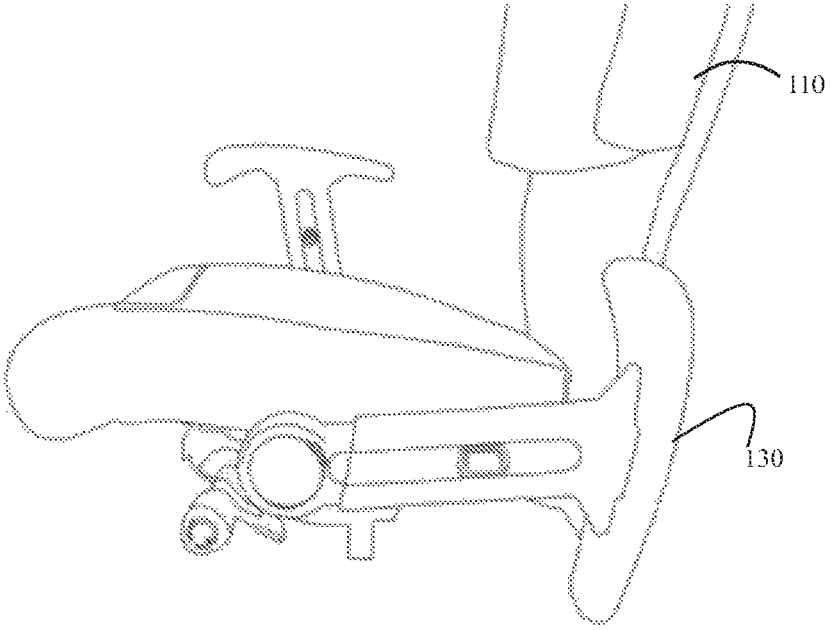
FIG. 8 is a diagram of the arm bracket depicted in the FIG. 7 being adjustably moved to a second position, according to an example embodiment.

FIG. 8 is a diagram of the arm bracket 130 depicted in the FIG. 7 being adjustably moved to a second position, according to an example embodiment.

FIG. 8 illustrates the arm bracket 130 moving from its position illustrated in the FIG. 7 to a full 90 degree range of motion toward the back 110.

It is noted that when the arm brackets 130 are adjustably moved forward and rearward, the seat clearance area is substantially increased for someone with attached weaponry or tools because the brackets 130 no longer exist to restrict the seat (side to side) clearance area when sitting in the chair 100.

Figure 9:
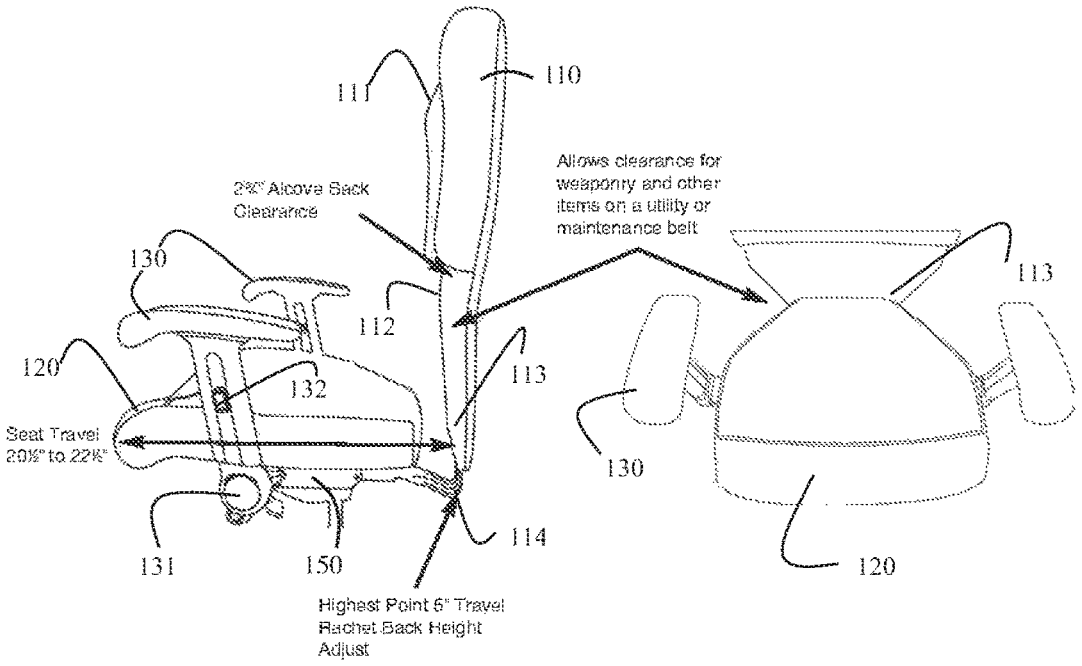
FIG. 9 are diagrams of a side view of the chair and a front view of the seat with a portion of the back, according to an example embodiment.

FIG. 9 are diagrams of a side view of the chair 100 and a front view of the seat 120 with a portion of the back 110, according to an example embodiment.

In an embodiment, the width of the second portion 112 is approximately $2\frac{3}{8}^{th}$ of an inch.

In an embodiment, the seat tilt and forward to rearward adjustment lever 150 allows the seat 120 to move in a parallel manner to a surface upon which the chair 100 is placed from a range of 20.5 inches to 22.5 inches; and allows the seat 120 to tilt at an angle.

The tapering of the back 110 from the first portion 111 to the second portion 112 and the second portion 112 to the third portion 113 as well as the tapering of the seat 120 from front to back provides additional clearance area for individuals with attached weaponry or tool utility belts. The width distance between the first portion 111 vis-à-vis the second 112 and third portions 113 also provides additional clearance area. Furthermore, the adjustment of the brackets 130 still provides forward to rearward clearance area.

Also, the additional thickness of the first portion 111 provides adequate upper back support for the individual sitting in the chair 100 while having attached weaponry or utility belt with tools.

Figure 10:
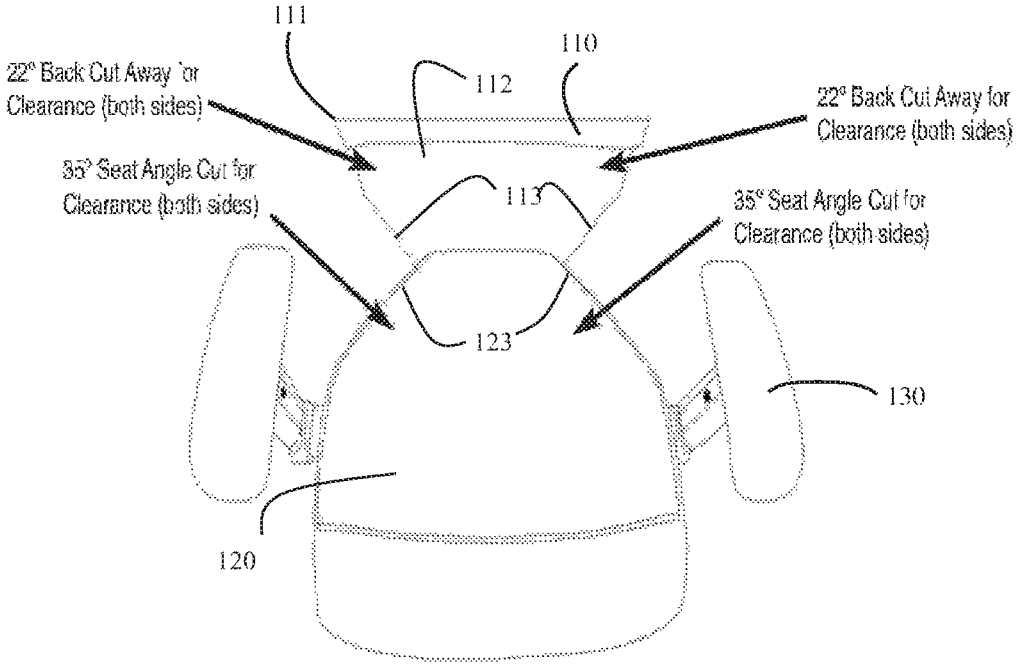
FIG. 10 is a diagram of another front view of the seat with the portion of the back, according to an example embodiment.

FIG. 10 is a diagram of another front view of the seat 120 with the portion of the back 110, according to an example embodiment.

The third portion 113 is tapered at an angle from the second portion 112 of 22 degrees that extends to the mechanism 114.

The seat 120 is tapered beginning at approximately an area on the seat 120 adjacent to the brackets 130 at an angle of approximately 35 degrees that extends to the back of the seat 120.

This illustrates the additional amount of clearance area towards the back of the seat 120 and at the back 110 for an individual with attached weaponry or a utility belt.

Figure 11:
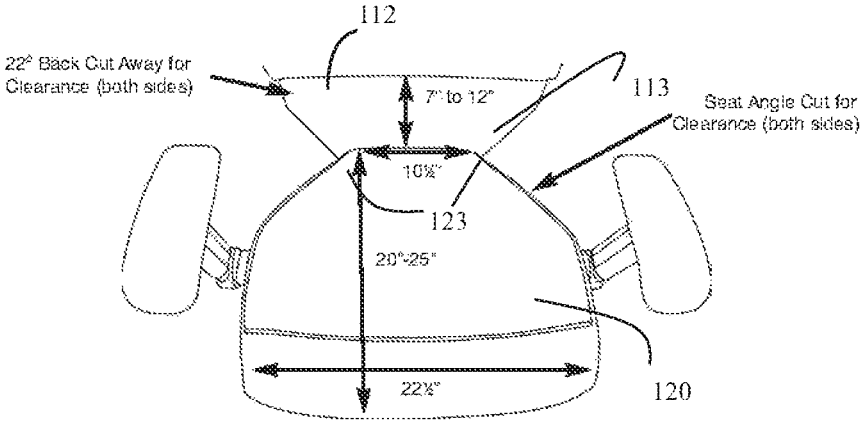
FIG. 11 is a diagram of still another front view of the seat with the portion of the back, according to an example embodiment.

FIG. 11 is a diagram of still another front view of the seat 120 with the portion of the back 110, according to an example embodiment.

In an embodiment, the third portion 113 and second portion 112 have a height extending from behind the back of the seat 120 to the first portion 111 of approximately 7 to 12 inches.

In an embodiment, the back fully tapered end of the seat 120 has a width of approximately 10.5 inches.

In an embodiment, the widest portion of the seat 120 at the front surface 121 is approximately 22.5 inches and the length of the seat 120 extending from the front to the back is approximately 20 to 25 inches.

Again, the tapered nature of the seat 120 and the back provide additional back clearance area when an individual with attached appendages (weaponry and/or tool belt) is sitting in the chair 100.

Figure 12:
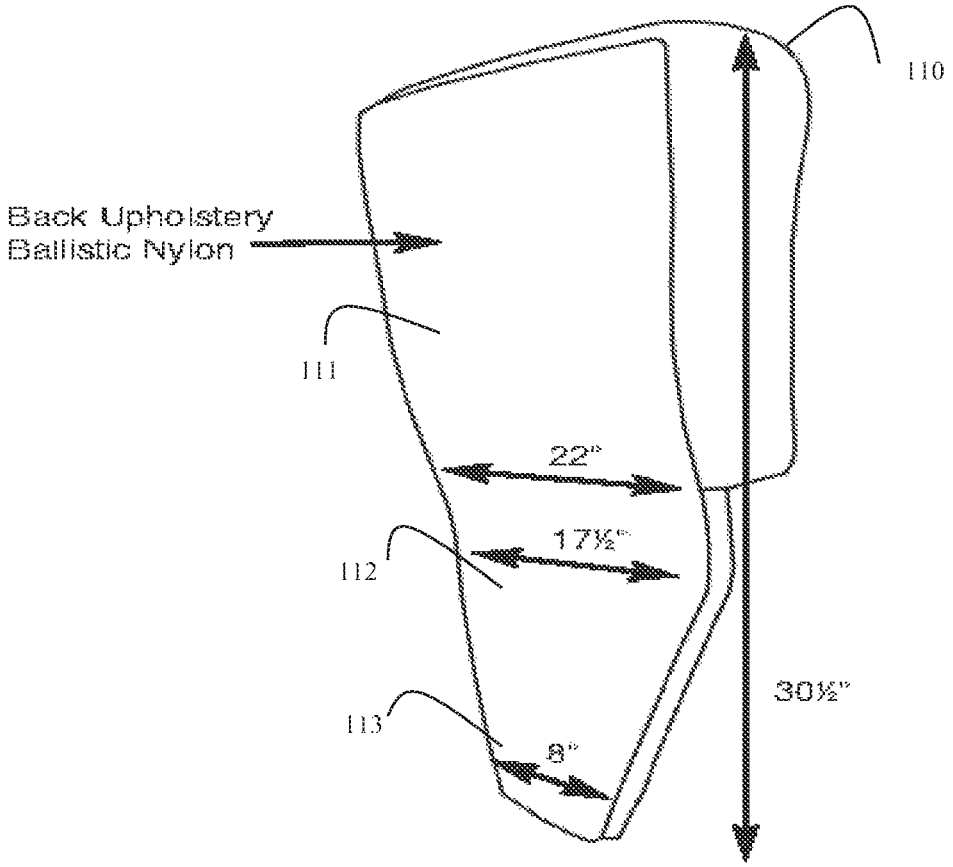
FIG. 12 is a back and side view of the back, according to an example embodiment.

FIG. 12 is a back and side view of the back 110, according to an example embodiment.

In an embodiment, the length of the back 110 or height of the back 110 is approximately 30.5 inches. The width of the first portion 111 is approximately 22 inches, the second portion 112 is approximately 17.5 inches, and the third portion 113 is approximately 8 inches.

The third portion 113 converges adjacent to the back of the seat (which is tapered and has a reduced width as illustrated in the FIG. 11).

Figure 13:
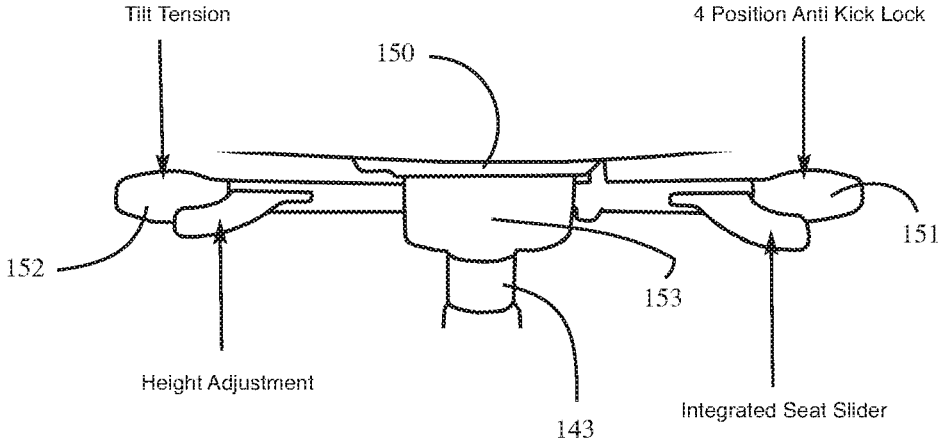
FIG. 13 is a diagram of adjustment mechanisms for the chair, according to an example embodiment.

FIG. 13 is a diagram of adjustment mechanisms 150 for the chair 100, according to an example embodiment.

The adjustment mechanisms 150 are attached to the cylinder 143 of the base 140 and a bottom surface of the seat 120.

The adjustment mechanism 150 includes two levers 151 and 152 that extend side to side on each side under the seat 120, such that an individual sitting in the chair 100 can access with either hand one of the levers. A center portion 153 of the mechanism 150 provides stability, balance, and separates the two levers 151 and 152.

In an embodiment, the lever 152 includes a tilt tension adjustment and a seat height adjustment handle.

In an embodiment, the lever 151 includes a 4 position anti kick lock and an integrated seat slider handle, such that the seat can be adjusted front to back and tilted.

One now appreciates how substantial side to side sitting clearance area is increased through the retractable brackets 130 and how back sitting clearance is increased through the tapering of the back 110, the seat 120, the width of the third portion 113, the width of the back of the seat 120, and the gap 115 between the back of the seat 120 and front surface of the third portion 113 of the back 110. This provides substantial clearance area for an individual sitting in the chair 100 with attached appendages on his/her person (such as weaponry and utility belts with tools).

The above description is illustrative, and not restrictive. Many other embodiments will be apparent to those skilled in the art upon reviewing the above description. The scope of embodiments should therefore be determined with reference to the appended claims, along with the full scope of equivalents to which such claims are entitled.

The invention claimed is:

1. A chair, comprising:

a portion of a back member that tapers from top to bottom at an angle of approximately 22 degrees, wherein the back member is attached under a bottom surface of a seat at a back of the seat, wherein a gap exists between a back surface of the seat and a front surface of the back member;

the seat that tapers from a front to the back at an angle of approximately 35 degrees;

two retractable arm brackets attached on opposing sides of the seat, each retractable arm bracket including a push button to retract the arms down in the rearward direction to provide a larger seat clearance from an original seat clearance when both of the two retractable arms are in an original upright position;

a seat height adjustment lever situated under the seat on a first side including a tilt tension adjustment on a first lever;

a front-to-back integrated seat slider adjustment lever situated under the seat on a second side;

a four position anti-kick lock lever situated under the seat on the second side and attached to the front-to-back integrated seat slider adjustment lever;

a center portion attached under the seat that includes the first lever, the seat slider adjustment lever, and the four position anti-kick lock lever; and a base including six legs, each leg including a caster.

2. The chair of claim 1, wherein the back member is approximately 30.5 inches in height.

3. The chair of claim 1, wherein a widest portion of the back member is approximately 22 inches at the top that tapers to approximately 17 inches in width and further tapers to approximately 8 inches in width at the bottom.

4. The chair of claim 1, wherein a length of the seat is approximately 20 to 25 inches.

5. The chair of claim 4, wherein the seat is approximately 22.5 inches wide at the front and approximately 10.5 inches wide at the back.

6. The chair of claim 1, wherein each of the two retractable arm brackets further include an arm height adjustment mechanism to adjustably change a height of the two retractable arm brackets relative to a top surface of the seat.

7. The chair of claim 1, wherein the push button is adapted to retract the two retractable arm brackets approximately 90 degrees in the rearward direction from the original upright position for a total range of retraction of approximately 90 degrees.

8. The chair of claim 1, wherein each of the seat height adjustment lever, the front-to-back integrated seat slider adjustment lever, and the four position anti-kick lock lever includes a release handle that activates the corresponding lever.

9. The chair of claim 1, wherein a distance between the two retractable arm brackets is approximately 29.75 inches.

10. The chair of claim 9, wherein a distance from back edges of the two retractable arm brackets to the front surface of the back is approximately 7 inches.

* * * * *